US005675152A

United States Patent [19]

Wong

[11] Patent Number: 5,675,152

[45] Date of Patent: Oct. 7, 1997

[54] SOURCE FILAMENT ASSEMBLY FOR AN ION IMPLANT MACHINE

[75] Inventor: Midas Wong, Hsin-Chu, Taiwan

[73] Assignee: Taiwan Semiconductor Manufacturing Company Ltd., Hsin-Chu, Taiwan

[21] Appl. No.: 586,521

[22] Filed: Jan. 16, 1996

[51] Int. Cl.[6] ..... H01J 27/00

[52] U.S. Cl. ..... 250/427; 315/111.81

[58] Field of Search ..... 250/424, 427; 315/111.41, 111.81; 313/231.31

[56] References Cited

U.S. PATENT DOCUMENTS

| | | | |
|---|---|---|---|
| 5,049,784 | 9/1991 | Matsudo | 25/427 |
| 5,256,947 | 10/1993 | Troy et al. | 315/111.81 |
| 5,262,652 | 11/1993 | Bright et al. | 250/427 |
| 5,370,568 | 12/1994 | Irins et al. | 445/3 |
| 5,517,077 | 5/1996 | Bright et al. | 250/426 |

*Primary Examiner*—Bruce Anderson

*Attorney, Agent, or Firm*—George O. Saile; William J. Stoffel

[57] ABSTRACT

An improved ion implant filament assembly, including shielding and insulation spacers, is provided that reduces the unwanted metal coating between the filament ends which shorts out the filament. An important parts of the invention are ridges on a filament shield which prevent coatings between filament ends and spacer insulators between the filament shield and the stage. The invention comprises a filament having a two parallel extending leads; two screws, each having a central hole; the leads extending through the central hole; a filament shield having two spaced apertures, the spaced apertures receiving the screws from a front side; the filament shield having annular ridges on the back side; a stage having two spaced apertures and a means to fix the stage to the source chamber; two annular spacer insulators positioned between the filament shield and the stage; and two end insulators each having a central aperture adapted to received one of the screws.

22 Claims, 4 Drawing Sheets

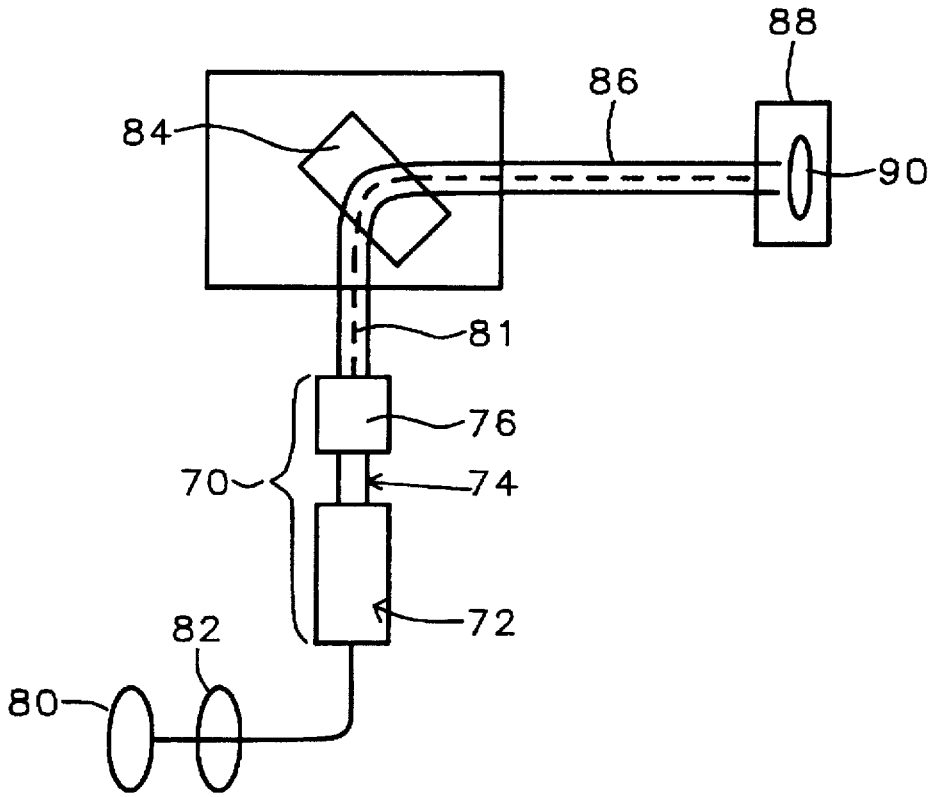
FIG. 1A – Prior Art

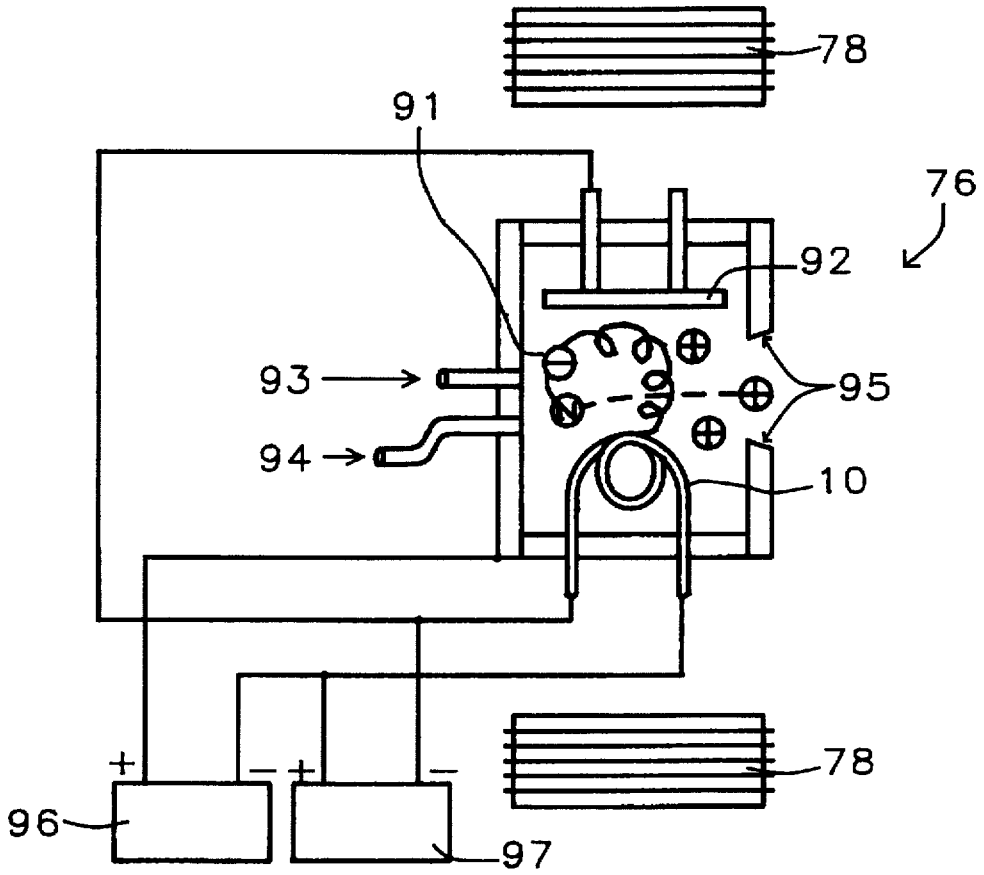
FIG. 1B – Prior Art

SOURCE FILAMENT ASSEMBLY FOR AN ION IMPLANT MACHINE

BACKGROUND OF THE INVENTION

1) Field of the Invention

This invention relates to a device for an ion implant machine used in semiconductor manufacturing, and more particularly to the source filament assembly for the ion source assembly.

2) Description of the Prior Art

Ion implantation is an important process in semiconductor manufacturing that must be performed accurately and reliably. An ion implanter implants impurity ions into a semiconductor substrate to form doped regions, such as sources and drains. The fundamental purpose of an ion implant system is to deliver a beam of ions of a particular type and energy to the surface of a silicon substrate. FIG. 1A shows a schematic view of an ion implanter. An ion source supply 80 (gas source) and an ion source power supply 82 connect to the ion source assembly 70. On the left-hand side, the gas source 80 supplies a small quantity of source gas such as $BF_3$, into the ion source assemble 70 where the gas passes through a vaporizer oven 72, a connection 74, and into the arc chamber 76. In the are chamber 76, a heated filament 10 causes the molecules to break up into charged fragments. (See FIG. 1B). This ion plasma contains the desired ion and many other unwanted species from other fragments and contamination. An extraction voltage, of about 20 kV, moves the charged ions out of the ion source assembly 82 into the analyzer 84. See FIG. 1A. The pressure in the remainder of the machine is kept below $10^{-6}$ Torr to minimize ion scattering by gas molecules. The magnetic field of the analyzer 84 is maintained such that only ions with the desired charge to mass ratio travel through without being blocked by the analyzer walls. Unblocked ions 81 continue to the acceleration tube 86, where they are accelerated to the implantation energy as then move from high voltage to ground. The ion beam 81 is well collimated by the apertures. The ion beam is then scanned over the surface of the wafer 90 using electrostatic deflection plates. The wafer 90 is offset slightly from the axis of the acceleration tube 86 so that ions neutralized during their travel will not be deflected on the wafer 90. A wafer handler 88 loads/unloads the wafers into an implanter wafer holder.

FIG. 1B shows a simplified schematic the arc chamber 76 of the ion source assemble 70 which contains the filament 10. The ion source 70 typically employs a tungsten filament located within an arc chamber 76 that has orifices 93 94 for the introduction of gas or vapor atoms and a slit 95 for the extraction of ions. The filament 10 is directly heated by passing an electric current through it using a filament power supply 97. This heating causes thermionic emission of electrons from the surface of the filament 10. An electric field, typically 30 to 150 volts is applied between the filament 10 and the arc chamber 76 walls using the arc power supply 96. This field accelerates the electrons 91 from the filament area to the arc chamber walls. A magnetic field is introduced perpendicular to the electric field and causes the electrons to spiral outward increasing the path length and chances for collisions with the gas molecules. The collisions break apart many of the molecules and ionize the resultant atoms and molecules by knocking outer shell electrons out of place. As charged particles, these atomic or molecular ions can now be controlled by magnetic and/or electric fields. The source magnets 78 change the ion path from a straight path to a helicoid path. With one or more electrons missing, the particles carry a net positive charge. An extraction electrode placed in proximity to the slit and held at a negative potential will attract and accelerate the charged particles out of the are chamber 76 through the slit 95.

A failure mode within an ionization implanter is the shorting of the source or filament element 10. In common terms, the filament coats over, especially during Boron implanting, and shorts out (e.g., arcs out) the filament so that no electrons are emitted. When the filament shorts out, it can't produce electrons and the ion implant machine will not work. Cleaning the filament is time consuming because the unit operates at a high vacuum pressure. The down time and complex repair procedures make this filament problem costly. Moreover, yield losses, maintenance costs, and down time make the problem costly.

Therefore there is a need to develop an improved arc chamber assembly that reduces the frequency of shorting the filament.

SUMMARY OF THE INVENTION

It is an object of the present invention to provide an improved arc chamber having a filament assembly that reduces the coating/shorting out of the filament.

It is an object of the present invention to provide an improved filament insulation and shielding assembly for are chamber that will reduce the filament coating and arcing problems.

According to the present invention, an ion source assembly having an improved ion source filament assembly is provided. The improvement being an filament insulation and shielding in the filament assembly which reduces the amount of unwanted metal deposits on the filament assembly and reduces coatings on the insulator between the filament ends. Key parts of the invention are the ridges on the filament shield and the spacer insulators. The ridges reduce the coating that short out the filament by acting as shields for the spacers insulators.

Briefly, the invention's ion source assembly in an ion implant machine has arc chamber, a vaporizer heater, and an ion source filament assembly. The filament assembly has specially designed parts to reduce the filament coating problem, such as a filament shield having ridges, a stage, and spacer insulators. The invention's ion source filament assembly comprises: a filament having a two parallel extending leads; two screws, each having a central hole; the leads extending through the central hole; a filament shield having two spaced apertures, the spaced apertures receiving the screws from a front side; the filament shield having annular ridges on the back side; the ridges spaced outwardly and concentric with the spaced apertures; a stage having two spaced apertures and a means to fix the stage to the source chamber; two annular spacer insulators positioned between the filament shield and the stage; each of the spacers insulators having: (a) a central aperture to receive on of two screws; (b) a cylindrical central portion having a diameter greater than the diameter of the aperture in the stage and filament shield; (c) a first cylindrical portion that is positioned within the filament shield; (d) a second opposite protruding portion that positioned in an aperture in the stage; and (e) an annular outwardly and centrally spaced flange on the central portion; two end insulators each having a central aperture adapted to received one of the screws; an end portion having a diameter greater than the aperture in the stage; and a protruding portion positioned in the aperture of the stage.

The filament assembly of the current invention has been shown to more than double the amount of time between filament maintenance/cleaning. The filament assembly reduces costly equipment down time, reduces expensive maintenance costs, and increases product yields by improving the source quality.

BRIEF DESCRIPTION OF THE DRAWINGS

The features and advantages of the filament assembly in accordance with the present invention will be more clearly understood from the following description taken in conjunction with the accompanying drawings in which like reference numerals designate similar or corresponding elements, regions and portions and in which:

FIG. 1A shows schematic view of a conventional ion implanter machine having an ion source assembly.

FIG. 1B is simplified schematic view of an arc chamber assembly of the prior art.

DETAILED DESCRIPTION OF THE PREFERRED EMBODIMENTS

Figure 2:
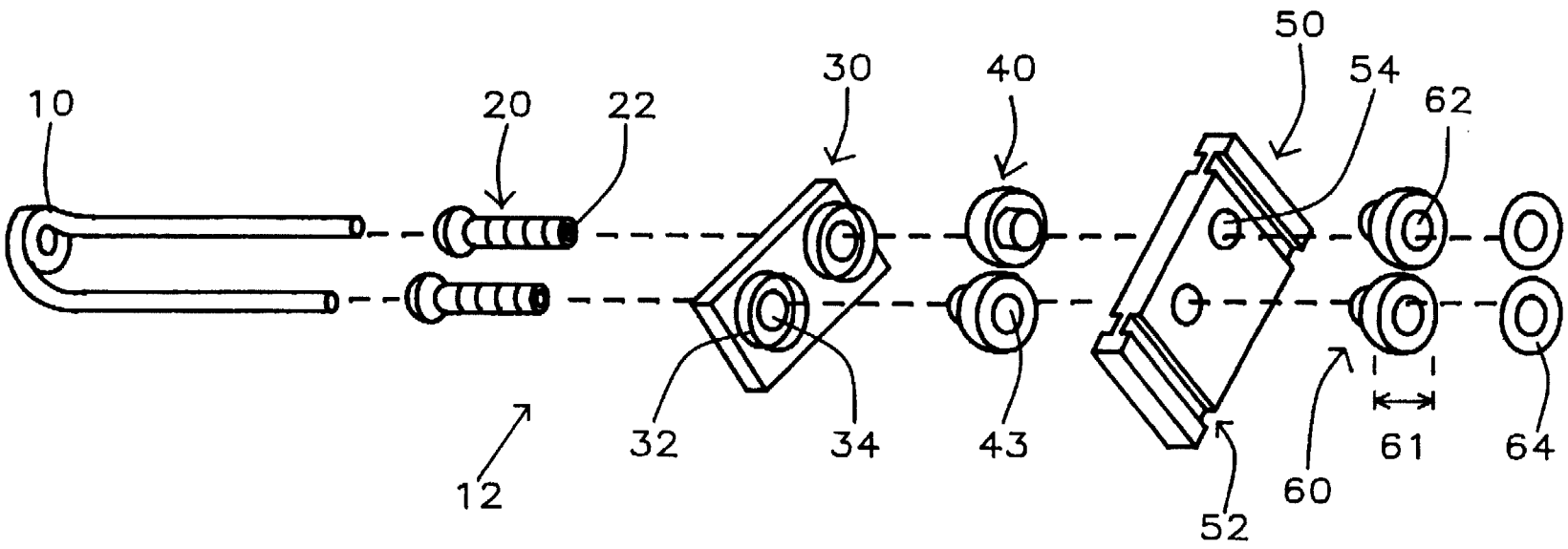
FIG. 2 is a perspective view of the filament insulation assembly of the present invention.

The present invention will be described in detail with reference to the accompanying drawings. According to the present invention, an improved ion source assembly for an ion implant machine is provided. The improvement being an filament assembly 12 having spacer insulators 40, a stage 50 and a filament shield 30. See FIG. 2. This design for the filament assembly 12 will work in most ion implanters and will especially work on a models NV-10SP and NV-10SD ion implanters by Eaton Semiconductor Equipment, 108 Cherry Hill Drive, Beverly, Mass., 01915, U.S.A.

FIG. 1*b* shows the are chamber 76 of an ion implanter. The are chamber is preferably formed of molybdenum because it is a heavy metal and its sputtering rate is low.

As shown in FIG. 2, a filament 10 having a two parallel extending leads is provided. The filament is preferably formed of tungsten. The filament 10 preferably has a diameter in the range between about 1.8 and 2.2 mm and more preferably about 2.0 mm.

Next, two screws 20, each having a central hole are provided. The leads from the filament 10 extend through the central hole 22. The screws 20 have an outer diameter in the range between about 3.8 and 4.2 mm and more preferably about 4.0 mm. The central holes 22 in the screws preferably have a diameter in the range between about 1.8 and 2.6 mm and more preferably about 2.0 mm. The filament 10 preferably has a snug fit with the inside of the screws 20. Also, the screws have a snug fit with the insulators 40 60. The heads of the screws have an outer diameter in the range between about 7.8 and 8.2 mm and more preferably about 8.0 mm.

The screws 20 are preferably threaded. Nuts 64 attach to the screws and help hold the assembly together. Preferably, the spacer insulators 40 and end insulators 60 are treaded and mesh with the screw threads to help hold the assembly together.

Figure 3:
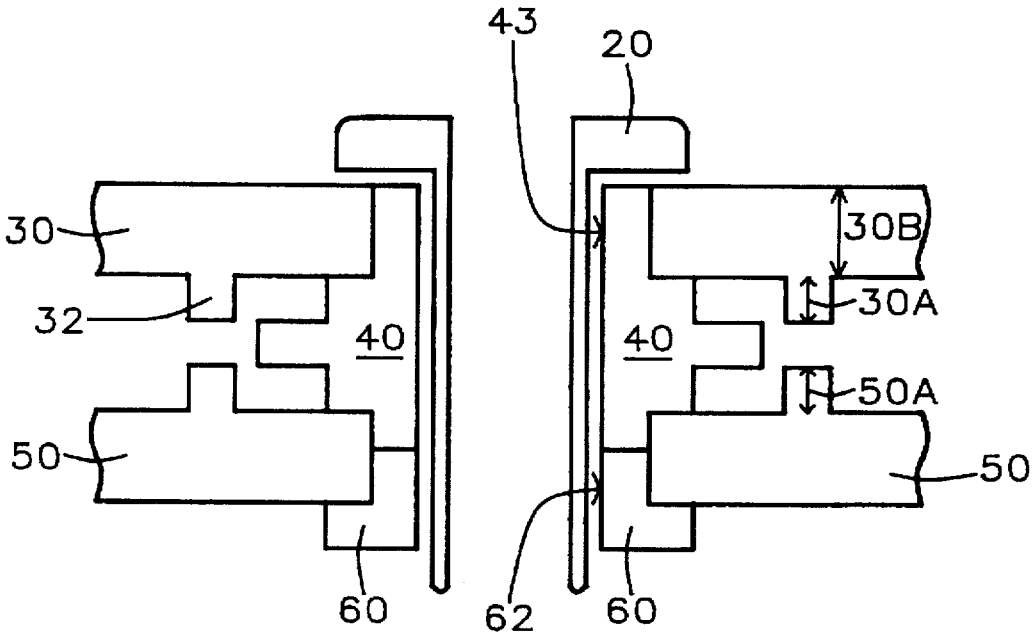
FIG. 3 is a cross-sectional view of the filament assembly of the present invention.

A filament shield 30 having two spaced apertures 34 is shown in FIGS. 2 and 3. The spaced apertures 34 receive the screws 20 from a front side. The filament shield 30 has a width 30B in the range between about 2.8 and 3.2 mm and more preferably about 3.0 mm. The filament shield 30 has annular ridges 32 on the back side. The ridges are spaced outwardly and concentric with the spaced apertures 34. The ridges 32 have a width 30A preferably in the range between about 1.9 and 2.1 mm and more preferably about 2.0 mm. The ridges preferably have a diameter in the range between about 11.8 and 12.2 mm and more preferably about 12.0 mm. The ridges 32 function to prevent coatings from building up on the spacer insulators 40 and shorting out the filament.

The stage 50 has two spaced apertures 54 and a means to fix the stage to the source chamber 76. The means is preferably two spaced groves 52 which fit into slots in the arc chamber as shown in FIG. 2. The aperture 54 preferably have a diameter in the range of 7.8 and 8.2 mm and more preferably about 8.0 mm. The stage 50 is preferably formed of molybdenum and preferably has a width in the range between about 5.8 and 6.0 mm.

Figure 2A:
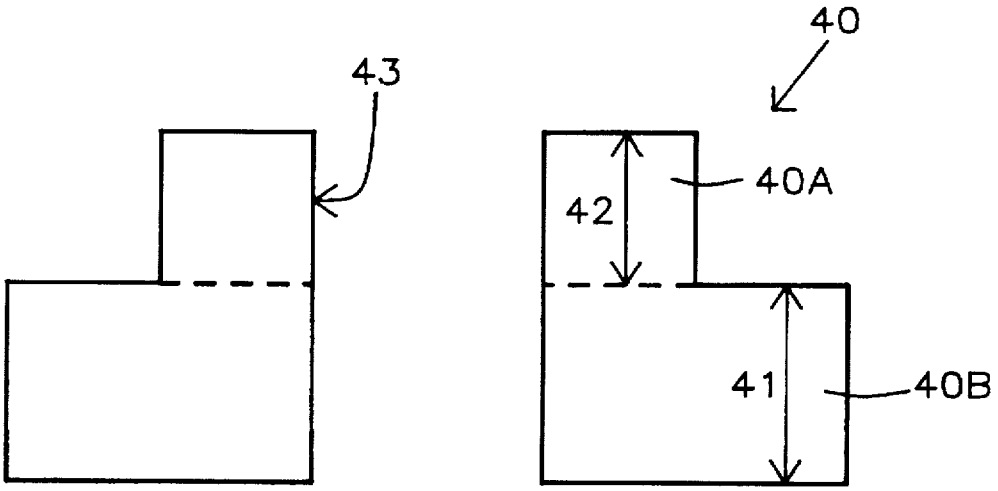
FIG. 2A is a cross sectional view of the spacer insulator 40 of the present invention.

Two annular spacer insulators 40 are positioned between the filament shield 30 and the stage 50 as shown in FIG. 2. Referring to FIGS. 2 and 2A, each of the spacers insulators 40 has: (a) a central aperture 43 to receive one of two screws 20; (b) a cylindrical first portion 40B having a diameter greater than the diameter of the apertures 54 in the stage 50 and filament shield 30; and (c) a second cylindrical portion that has a smaller diameter than the first portion. The first portion 40B preferably has a diameter in the range between about 9.8 and 10.2 mm and more preferably about 10.0 mm The first portion preferably has a width 41 in the range between about 2.8 and 3.2 mm and more preferably about 3.0 mm. The smaller second portion 40A preferably has a diameter in the range between about 6.8 and 7.2 mm and more preferably about 7.0 mm. The second portion 40A preferably has a width 42 in the range between about 2.8 and 3.2 mm and more preferably about 3.0 mm. The central aperture 43 in the spacer insulators preferably have a diameter in the range between about 4.2 and 4.7 mm and more preferably about 4.5 mm. Also, the screws 20 have a snug fit with the insulators 40 60.

As shown in FIG. 2, the spacers 40 are preferably positioned facing opposite directions. Facing the spacer insulators 40 in opposite directions causes the screws to have different electrical potential which reduces the coating problem. The insulator spacers 40 are preferably made of an insulating ceramic material.

FIG. 3 shows another preferred embodiment of the filament assembly of the present invention. FIG. 3 shows the screw 20 positioned through apertures 43 62 in the spacer insulator 40 and the end insulator 60. The spacer insulator 40 and the end insulator 60 are positioned through the apertures 34 54 in the filament shield 30 and the stage 50. Here, the insulator has a two step shape. Also the stage 50 is shown with an annular ridge on the back side. The annular ridge can have a height 50A in the range of between about 1.8 and 2.2 mm. The filament shield 30 preferably has a width 30B in the range of between about 2.8 and 3.2 mm.

Two end insulators 60, each having a central aperture 62, are adapted to received one of the screws 20. An end portion has a diameter greater than the aperture 54 in the stage 50; and a protruding portion extending into the aperture 54 of the stage 50. The central aperture 62 has a diameter in the range between about 4.3 and 4.7 mm and more preferably about 4.5 mm. The end portion preferably has a diameter 61 in the range between about 12.8 and 13.2 mm and more preferably about 13.0 mm. The end portion preferably has a width in the range between about 2.8 and 3.2 mm and more preferably about 3.0 mm. The protruding portion preferably has a width in the range between about 2.8 and 3.2 mm and more preferably about 3.0 mm.

The source filament assembly 12 preferably include nuts 64 that are threaded and receive the ends of the screws 20. The nut are used to hold the assembly together.

The filament assembly of the current invention has been shown to more than double the amount of time between filament maintenance and cleaning. The ridges 32 in the filament shield 30 prevent coating by covering the critical joints between spacer insulator 40 and the filament shield 30. The filament assembly reduces costly equipment down time, reduces expensive maintenance costs and increases product yields by improving the source quality. Moreover, the filament assemble prolongs filament lifetime.

While the invention has been particularly shown and described with reference to the preferred embodiments thereof, it will be understood by those skilled in the art that various changes in form and details may be made without departing from the spirit and scope of the invention.

What is claimed is:

1. An ion source filament assembly for an ion implant machine comprising:

a filament having two parallel extending leads;

two screws, each having a central hole; said leads extending through said central holes;

a filament shield having two spaced apertures, said spaced apertures receiving said screws from a front side; said filament shield having annular ridges on the back side; said ridges spaced outwardly and concentric with said spaced apertures;

a stage having two spaced apertures;

two annular spacer insulators positioned between said filament shield and said stage; each of said spacers insulators having: (a) a central aperture to receive one of said two screws; (b) a cylindrical first portion having a diameter greater than said diameter of said apertures in said stage and said filament shield; and (c) a second cylindrical portion that has a smaller diameter than said first portion; and two end insulators each having: (a) a central aperture adapted to received one of said screws; (b) an end portion having a diameter greater than said aperture in said stage; and (c) a protruding portion positioned in an aperture of said stage;

said filament shield covering said stage between said two parallel extending leads and covering said spacer insulators whereby coatings are prevented from forming between said two parallel extending leads.

2. The ion source filament assembly of claim 1 wherein said screws have an outer diameter in the range between about 3.8 and 4.2 mm; and said central holes in said screws have a diameter in the range between about 1.8 and 2.6 mm; and said screw having a head with an outer diameter in the range between about 7.8 and 8.2 mm.

3. The ion source filament assembly of claim 1 wherein said ridges of said filament shield have a width in the range between about 1.9 and 2.1 mm; and said ridges have a diameter in the range between about 11.8 and 12.2 mm.

4. The ion source filament assembly of claim 1 wherein said two spaced apertures of said stage have a diameter in the range of 7.8 and 8.2 mm; and said stage is preferably formed of molybdenum, and has a width in the range between about 5.8 and 6.0 mm.

5. The ion source filament assembly of claim 1 wherein said cylindrical first portion of said spacer insulators has a diameter in the range between about 9.8 and 10.2 mm; and said first portion has a width in the range between about 2.8 and 3.2 mm; and said cylindrical second portion has a diameter in the range between about 6.8 and 7.2 mm; and said central aperture in said spacer insulators have a diameter in the range between about 4.2 and 4.7 mm.

6. The ion source filament assembly of claim 1 wherein one of said spacer insulators is positioned with the first portion facing said filament shield and the other of said spacer insulators is facing said stage.

7. The ion source filament assembly of claim 1 wherein said spacer insulators are formed of a ceramic material.

8. The ion source filament assembly of claim 1 wherein said central aperture of said end insulator has a diameter in the range between about 4.3 and 4.7 mm; and said end portion has a diameter in the range between about 12.8 and 13.2 mm and said end portion has a width in the range between about 2.8 and 3.2 mm and said protruding portion of said end insulator has a width in the range between about 2.8 and 3.2 mm.

9. The ion source filament assembly of claim 1 which further includes an arc chamber is formed of molybdenum and said stage has slots to attach to said are chamber.

10. The ion source filament assembly of claim 1 wherein said stage has a front side facing said filament shield; said stage further includes annular ridges on said front side.

11. An arc chamber in an ion implant machine; said arc chamber having an ion source filament assembly; comprising:

a filament having two parallel extending leads;

two screws, each screw having a central hole; said leads extending through said central holes;

a filament shield having two spaced apertures, said spaced apertures receiving said screws from a front side; said filament shield having annular ridges on the back side; said ridges spaced outwardly and concentric with said spaced apertures;

a stage having two spaced apertures and a means to fix said stage to said arc chamber; said stage having a front side facing said filament shield; said stage further includes annular ridges on said from side;

two annular spacer insulators positioned between said filament shield and said stage; each of said spacers insulators having: (a) a central aperture to receive one of said two screws; (b) a cylindrical first portion having a diameter greater than said diameter of said aperture in said stage and filament shield; and (c) a second cylindrical portion that has a smaller diameter than said first portion;

two end insulators each having: (a) a central aperture adapted to received one of said screws; (b) an end portion having a diameter greater than said aperture in said stage; and (c) a protruding portion positioned in an aperture of said stage;

said stage attached to said arch chamber by said means;

said filament shield covering said stage between said two parallel extending leads and covering said spacer insulators whereby coatings are prevented from forming between said two parallel extending leads.

12. The arc chamber of claim 11 wherein said filament has a diameter in the range between about 1.8 and 2.2 mm.

13. The are chamber of claim 11 wherein said screws have an outer diameter in the range between about 3.8 and 4.2 mm; and said central hole in said screws have a diameter in the range between about 1.8 and 2.6 mm; and said screw having a head having an outer diameter in the range between about 7.8 and 8.2 mm.

14. The arc chamber of claim 11 wherein said ridges of said filament shield have a width in the range between about 1.9 and 2.1 mm; and said ridges have a diameter in the range between about 11.8 and 12.2 mm.

15. The arc chamber of claim 11 wherein said two spaced apertures of said stage have a diameter in the range of 7.8 and 8.2 mm; and said stage is preferably formed of molybdenum; and has a width in the range between about 5.8 and 6.0 mm.

16. The arc chamber of claim 11 wherein said first portion of said cylindrical spacer insulators has a diameter in the range between about 9.8 and 10.2 mm; and said first portion has a width in the range between about 2.8 and 3.2 mm; and said second portion has a diameter in the range between about 6.8 and 7.2 mm; and said central aperture in said spacer insulators have a diameter in the range between about 4.2 and 4.7 mm.

17. The arc chamber of claim 11 wherein one of said spacer insulators is positioned with the first portion facing said filament shield and the other spacer insulator is facing said stage.

18. The arc chamber of claim 11 wherein said spacer insulators are formed of a ceramic material.

19. The are chamber of claim 11 wherein said central aperture of said end insulator has a diameter in the range between about 4.3 and 4.7 mm; and said end portion has a diameter in the range between about 12.8 and 13.2 mm and said end portion has a width in the range between about 2.8 and 3.2 mm and said protruding portion of said end insulator has a width in the range between about 2.8 and 3.2 mm.

20. The arc chamber of claim 11 wherein said arc chamber is formed of molybdenum.

21. An arc chamber in an ion implant machine; said arc chamber having an ion source filament assembly; comprising:

a filament having two parallel extending leads;

two screws, each screw having a central hole; said leads extending through said central holes;

a filament shield having two spaced apertures, said spaced apertures receiving said screws from a front side; said filament shield having annular ridges on the back side; said ridges spaced outwardly and concentric with said spaced apertures; said ridges of said filament shield have a width in the range between about 1.9 and 2.1 mm; and said ridges have a diameter in the range between about 11.8 and 12.2 mm;

a stage having two spaced apertures and a means to fix said stage to said arc chamber; said stage having a front side facing said filament shield; said stage further includes annular ridges on said front side;

two annular spacer insulators positioned between said filament shield and said stage; each of said spacers insulators having: (a) a central aperture to receive one of said two screws; (b) a cylindrical first portion having a diameter greater than said diameter of said aperture in said stage and filament shield; and (c) a second cylindrical portion that has a smaller diameter than said first portion; said first portion of said spacer insulators has a diameter in the range between about 9.8 and 10.2 mm; and said first portion has a width in the range between about 2.8 and 3.2 mm; and said second portion has a diameter in the range between about 6.8 and 7.2 mm; and said central aperture in said spacer insulators have a diameter in the range between about 4.2 and 4.7 mm; said spacer insulators are formed of a ceramic material;

two end insulators each having: (a) a central aperture adapted to received one of said screws; (b) an end portion having a diameter greater than said aperture in said stage; and (c) a protruding portion positioned in an aperture of said stage; and said stage attached to said arch chamber by said means;

said filament shield covering said stage between said two parallel extending leads and covering said spacer insulators whereby coatings are prevented from forming between said two parallel extending leads.

22. The arc chamber of claim 21 wherein one of said spacer insulators is positioned with the first portion facing said filament shield and the other spacer insulator is facing said stage.

* * * * *